United States Patent [19]

Nieminen

[11] Patent Number: 4,805,080

[45] Date of Patent: Feb. 14, 1989

[54] POWER SUPPLY CIRCUIT FOR AN X-RAY TUBE

[75] Inventor: Tero Nieminen, Helsinki, Finland

[73] Assignee: Radiante OY, Helsinki, Finland

[21] Appl. No.: 133,500

[22] Filed: Dec. 16, 1987

[51] Int. Cl.[4] ..... H02H 7/122

[52] U.S. Cl. ..... 363/56; 363/133; 378/101

[58] Field of Search ..... 363/55, 56, 71, 124, 363/133, 134; 323/268, 271, 272, 908; 378/101, 103, 105–107, 111–112

[56] References Cited

U.S. PATENT DOCUMENTS

| | | | |
|---|---|---|---|
| 3,925,715 | 12/1975 | Venable . | |
| 3,938,024 | 2/1976 | Clarke | 363/24 |
| 4,190,883 | 2/1980 | Cowett, Jr. | 363/26 |
| 4,371,918 | 2/1983 | Schierjott . | |
| 4,654,770 | 3/1987 | Santurtun et al. | 363/56 |
| 4,698,742 | 10/1987 | Jones et al. | 363/134 |

FOREIGN PATENT DOCUMENTS

| | | |
|---|---|---|
| 136690 | 11/1977 | Denmark . |
| 2544006 | 7/1977 | Fed. Rep. of Germany . |
| 833833 | 4/1985 | Finland . |
| 55-117333 | 9/1980 | Japan . |

*Primary Examiner*—Peter S. Wong

*Attorney, Agent, or Firm*—Morse, Altman, Dacey & Benson

[57] ABSTRACT

The invention relates to a power supply circuit for an X-ray tube for converting direct current to high-frequency pulses and including at least two transistors (8, 9) whose collector-emitter circuits are controlled by means of a pulse-width modulator (5) through base control transformers (12) in a manner that transistors (8, 9) operate in push-pull fashion, one terminal (+) of a direct-current source being connected to the collector-emitter circuit of transistors (8, 9). The collector-emitter circuit of each transistor (8, 9) is separately connected through its own transformer (23, 23*a*) to said one terminal (+) of a direct-current source in a manner that the primary windings (24, 24*a*) of transformers (23, 23*a*) serve as ballasts limiting the current passing through transistors (8, 9) and the secondary windings (25, 25*a*) is connected in series with diodes (26) between the terminals terminals (+ and −) of a direct-current source.

7 Claims, 3 Drawing Sheets

POWER SUPPLY CIRCUIT FOR AN X-RAY TUBE

The present invention relates to a power supply circuit for an X-ray tube for converting direct current to high-frequency pulses which are fed into a voltage step-up circuit, said power supply circuit including at least two transistors whose collector-emitter circuits are controlled through base control transformers in a manner that the transistors operate in push-pull fashion, one of the terminals of a direct-current source being coupled for supplying power to the collector-emitter circuit of the transistors.

As known in the art, a thus obtained pulse-shaped voltage is amplified to high voltage before it can be used in an X-ray tube. This voltage step-up circuit provides a circuit with a particularly troublesome impendance. When the question is about remarkably high powers, e.g. in the order of kilowatt, this unstable impedance load sets particular requirements on a power supply circuit. When the transistor of a pulse switcher becomes conductive, the current starts to step up quickly and pretty well without restrictions, which would result in the immediate destruction of a power transistor.

This is why the prior art power supply circuits employ two successive pulse switcher stages and further a matching transformer.

An object of the invention is to provide an improved power supply circuit, which only requires one pulse switches stage and current limitation can be effected without any particular matching transformer between power supply circuit and load impedance.

According to the invention, this object is achieved in a manner that the base control transformers receive their control from a pulse-width modulator which, in turn, is coupled to receive a feedback control from a voltage step-up circuit, and that the collector-emitter circuit of each transistor is separately connected through its own transformer to said one terminal of a direct-current source in such a manner that the primary windings of the transformers serve as ballasts limiting the current passing through the transistors and the secondary windings are connected in series with diodes between the terminals of a direct-current source.

A further advantage gained by a pulse converter of the invention is that, since each transistor circuit is provided with its own transformer instead of a single common transformer, it is possible to eliminate the objectionable current peaks at the time of a switchover, i.e. as the current switches from one transistor circuit over to the other.

Figure 1:
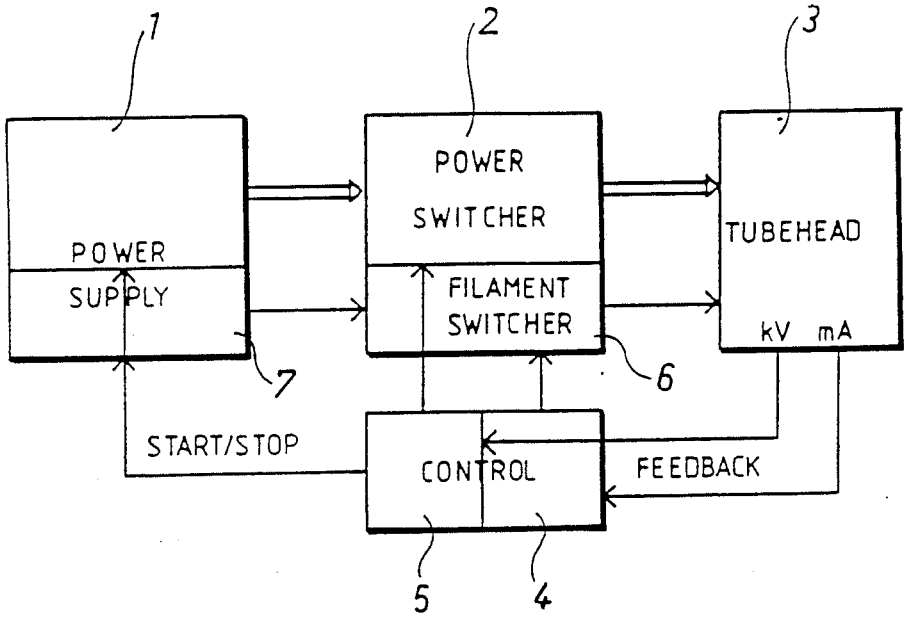
Figure 2:
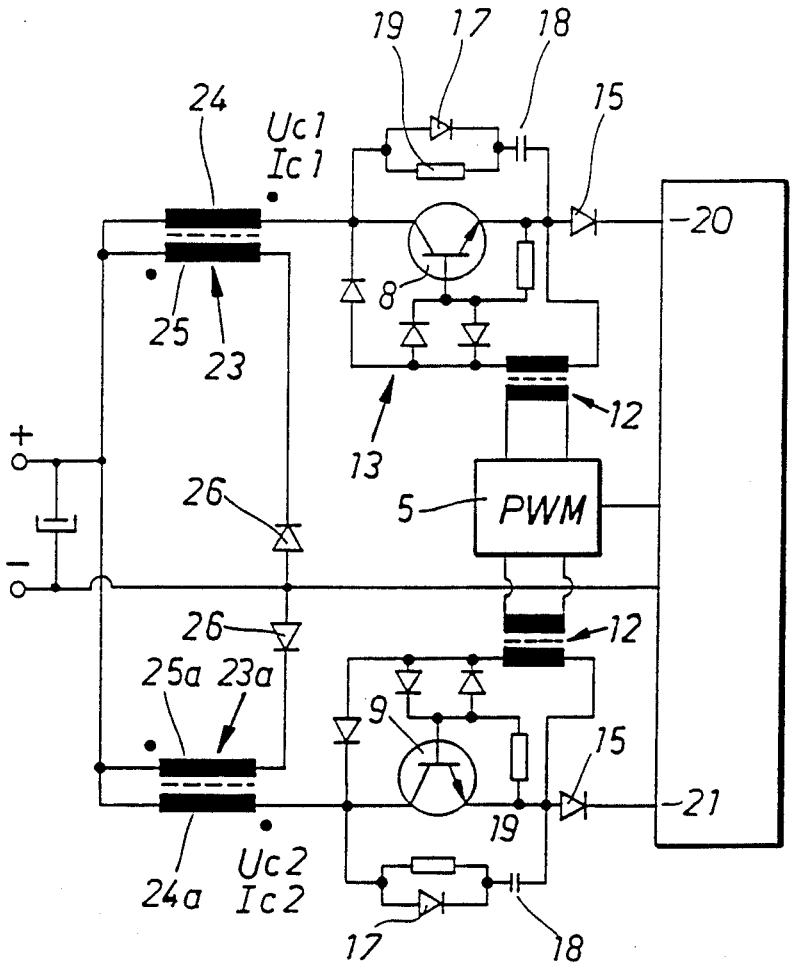
Figure 3:
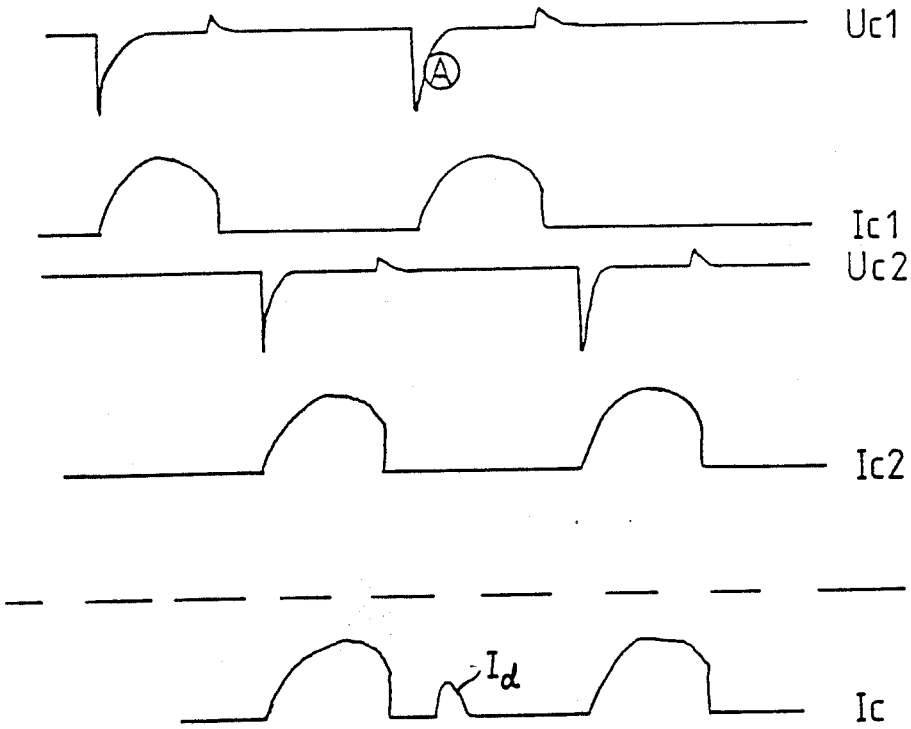

One embodiment of the invention will now be described with reference made to the accompanying drawings, in which FIG. 1 shows a general block diagram of an X-ray power supply circuit, FIG. 2 shows a pulse switcher (block 2) of the invention which is part of the power supply circuit of FIG. 1 and FIG. 3 shows the voltage and current curves for the circuits of a pulse switcher of the invention.

Referring to FIG. 1, a power supply block 1 comprises a mains-connected rectifier followed by a major capacitor which serves as the direct-current source for a pulse switcher 2, the latter delivering pulse-shaped electricity in the order of 30 kHz to an X-ray tube voltage step-up circuit 3. There is a feedback from circuit 3 to a control units 4 and 5, whereof the control unit 4 controls an X-ray tube filament current switching unit 6 and the control unit 5 is provided with a pulse-width modulator (e.g. Motorola TL 494) which controls the pulse width of pulse switcher 2 so as to attain and maintain the voltage set in circuit 3. Said control unit 5 comprises further a "start/stop" control for power supply units 1 and 7.

A block diagram 1 is otherwise conventional but a novel and special feature is that it only includes one pulse switcher 2, which is possible by virtue of a novel and special coupling and control of pulse switcher 2. This is described with reference to FIG. 2.

In FIG. 2, the collectors of power transistors 8 and 9 are connected through transformers 23, 23*a* to one terminal (+) of a direct-current source and the emitters are connected through diodes 15 to the output terminals 20 and 21 of a pulse switcher. The control of transistors 8 and 9 is effected by means of said pulse-width modulator, which is part of the control unit, through the intermediary of base control transformers 12. Thus, between outputs 20, 21 and the other terminal (−) of a direct-current source are obtained high-frequency pulses, whose pulse width is automatically adjusted on the basis of a feedback so as to attain a desired voltage for an X-ray tube.

Reference numerals 13 designate anti-saturation diodes for the transistors. In order to prevent the voltage and current peaks created in load impedance from destroying the transistors, there are diodes 15 and 17 through which such voltage and current peaks are passed to a capacitor 18 and discharged therefrom through a resistance 19 while a corresponding transistor is controlled to be conductive.

One terminal (+) of a direct-current source is connected to a point 25 between transistors 8 and 9. In itself, there is nothing special about an inverter switching except for the power regulation by means of pulse-width control, said regulation being based on a feedback. In a pulse-switcher or inverter circuit of FIG. 2 the current limitation is further effected by means of separate transformers 23, 23*a*. The primary winding 24 and 24*a* of each transformer 23 and 23*a* is coupled between the terminal (+) of a direct-current source and the collector of a live transistor 8 and 9. Thus, primary windings 24 and 24*a* serve as a current limiter the same way as a ballast. As the transistor switches 8 and 9 switch current on and off, the inductance of winding 24, 24*a* would create such high voltage and current peaks that the transistors would be destroyed. In order to prevent this, the secondary winding 25, 25*a* of each transformer 23 and 23*a* is connected in series with a diode 26 between the terminals (+ and −) of a direct-current source. By a correct selection of the directions of windings 24, 24*a* and 25, 25*a* as well as diode 26, the voltage and current peaks generating from primary winding 24, 24*a* can be delivered back to a direct-current source.

If a common transformer known as such from DOS publication 2544006 is employed between the collectors of transistors and the terminal (+) of a current source, the result will be a current curve Ic, shown at the bottom of FIG. 3 and indicating a distinct disturbance peak Id as voltage Uc1 steps up at point A, i.e. when current switches from one transistor circuit over to the other. Said disturbance peak in the current of a non-conducting transistor circuit is due to the fact that the voltage peak (at point A) of a transistor turning conductive creates a current through a safety circuit 17, 18, 19 of the first-mentioned transistor circuit. When employing two separate transformers 23, 23*a* according to the invention, the voltage and current curves will like curves Uc1, Ic1 and Uc2, Ic2 shown in FIG. 3. It can be seen from the curves that said current peak has disappeared.

I claim:

1. A power supply circuit for an X-ray tube for converting direct current to high-frequency pulses that are fed into a voltage step-up circuit of said X-ray tube, said power supply circuit comprising:

(a) a direct-current source having a positive and a negative terminal;

(b) a pair of transistors, each having a collector, an emitter and a base;

(c) a pair of transformers, each having a primary and a secondary winding;

(d) the collector of each of said pair of transistors being coupled via said primary winding of one of its said pair of transformers to said positive terminal of said direct-current source, said primary windings functioning as ballasts limiting the current passing through said pair of transistors;

(e) a pair of diodes coupling said secondary windings of each of said pair of transformers in series between said positive and negative terminals of said direct-current source;

(f) a control unit including a pulse-width modulator and a pair of base-control transformers coupling said modulator to their respective one of said pair of transistors, said pulse-width modulator connected to receive a feedback control signal from said voltage step-up circuit of said X-ray tube;

(g) said pair of base-control transformers controlling the collector-emitter circuits of each of their said respective pair of transistors such that said pair of transistors operate in a push-pull configuration.

2. The power supply circuit of claim 1 wherein each of said pair of base-control transformers is coupled to the base of its respective pair of transistors via a pair of anti-saturation diodes.

3. The power supply circuit of claim 1 further including a safety circuit for each of said pair of transistors, said safety circuit being connected in a loop between said emitter and said collector thereof.

4. The power supply circuit of claim 3 wherein said safety circuit comprises a capacitor and a parallel-coupled diode and resistor connected to said capacitor.

5. The power supply circuit of claim 1 wherein said direct-current source comprises a mains-connected rectifier and a capacitor coupled thereto.

6. The power supply circuit of claim 1 wherein said feedback control signal received by said pulse-width modulator from said voltage step-up circuit of said X-ray tube serves automatically to adjust the pulse width of said high-frequency pulses being fed into said voltage set-up circuit, supplying a voltage regulated power to said X-ray tube.

7. The power supply circuit of claim 1 wherein each of said pair of transistors is an NPN transistor.

* * * * *